US006640368B2

(12) United States Patent
Roston

(10) Patent No.: US 6,640,368 B2
(45) Date of Patent: Nov. 4, 2003

(54) THERAPEUTIC LEG SUPPORT PILLOW

(76) Inventor: Stewart A. Roston, 287 George St., New Brunswick, NJ (US) 08901

( * ) Notice: Subject to any disclaimer, the term of this patent is extended or adjusted under 35 U.S.C. 154(b) by 0 days.

(21) Appl. No.: 10/223,045

(22) Filed: Aug. 19, 2002

(65) Prior Publication Data

US 2003/0046767 A1 Mar. 13, 2003

Related U.S. Application Data

(60) Provisional application No. 60/318,594, filed on Sep. 13, 2001.

(51) Int. Cl.[7] ..... A47C 20/00

(52) U.S. Cl. ..... 5/648; 5/650; 5/657; 5/655.9

(58) Field of Search ..... 5/698, 650, 652, 5/640, 655.9, 657; 128/882

(56) References Cited

U.S. PATENT DOCUMENTS 2,877,472 A * 3/1959 Wagner ..... 5/636
5,125,123 A * 6/1992 Engle ..... 5/648
5,216,771 A * 6/1993 Hoff ..... 5/648
5,418,991 A * 5/1995 Shiflett ..... 5/650
6,145,508 A * 11/2000 Seip, Jr. ..... 128/845
6,182,311 B1 * 2/2001 Buchanan et al. ..... 5/632
2002/0088057 A1 * 7/2002 Wassilefsky ..... 5/648

FOREIGN PATENT DOCUMENTS

GB 2030448 A * 4/1980

* cited by examiner

*Primary Examiner*—Michael F. Trettel
(74) *Attorney, Agent, or Firm*—Clifford G. Frayne

(57) ABSTRACT

A therapeutic between the legs support pillow having a generally rectangular foot print when not in use, having a first surface and a second channeled surface opposite the first surface, the second channel surface having a plurality of intersecting channels cooperative with the thighs, knees and calves of an individual when the therapeutic between the legs pillow is folded upon its first surface, the therapeutic between the legs support pillow having a biasing means cooperable with the weight of the thighs, knees and calves so as to maintain proper spinal alignment.

4 Claims, 3 Drawing Sheets

THERAPEUTIC LEG SUPPORT PILLOW

RELATED APPLICATIONS

Applicant claims the benefit of provisional application 60/318,594 filed Sep. 13, 2001.

BACKGROUND OF THE INVENTION

1. Field of the Invention

The present invention relates to support pillows and more particularly, to a therapeutic support pillow to be placed between the legs of a person when lying on their side.

2. Description of the Prior Art

A majority of individuals sleep on their sides as opposed to on their backs or stomachs. For a healthy person this position is often very comfortable, however, it does cause a bending of the spinal cord, compression of the internal organs, and concomitant strain on muscles, ligaments, bones and joints. It also results in prolonged contact between the thighs, knees and calves, which can lead to an interruption of blood flow, bruising, and possible cramps.

The aforesaid drawbacks to sleeping on one's side for a healthy individual are multiplied if the individual suffers one of a plurality of medical problems. A sufferer of arthritis, back pain, particularly lower back pain, and various knee and hip conditions can aggravate those conditions by sleeping on one's side. Still further, obese individuals and pregnant women who sleep on their sides generate additional pressure on the lumbar, spine and sacroiliac joint.

To provide for a more restful sleep when one sleeps on one's side, individuals have oftentimes resorted to placing an object between their legs, such as a standard bed pillow. Indeed, medical practitioners have oftentimes recommended patients place an object such as a pillow between their legs. The pillow between the legs aids in the proper alignment of the spine, thighs and calves and relieves the discomfort heretofore mentioned. The drawback is that conventional pillows are not shaped properly to provide the appropriate support and they are easily displaced during the sleep period.

Efforts have been made to address the support pillow problem as evidenced by U.S. Pat. No. 6,182,311 to Buchanan, et al.; U.S. Pat. No. 4,584,730 to Rajan; U.S. Pat. No. 4,736,477 to Moore; U.S. Pat. No. 5,117,522 to Everett; and U.S. Pat. No. 5,664,271 to Bellavance.

All of these efforts attempt to provide for a between the legs support pillow, but each suffers a shortcoming, such as a complicated design; the need for straps and securing means in some cases; and bulky assembly, providing a cumbersome pillow assembly which must be stored in a closet or under the bed when not in use.

Applicant's therapeutic between the legs support pillow positions the thigh, knee and calf of the individual; maintains a biasing between the legs of the individual and when not in use, the one piece assembly is substantially planar such that it looks like a pillow and could be placed under the normal head pillow when the bed is made.

OBJECTS OF THE INVENTION

An object of the present invention is to provide for a novel therapeutic between-the-leg support pillow which maintains proper alignment of the spine during sleep periods.

A further object of the present invention is to provide for a novel therapeutic between-the-legs support pillow which is easily maintained in position during individual sleeping period.

A still further object of the present invention is to provide for a novel therapeutic between-the-legs support pillow which minimizes contact between the thighs, knees and calves of an individual when sleeping on their side and thus avoiding obstruction of blood flow, bruising and cramps.

A still further object of the present invention is to provide for a novel therapeutic between-the-legs pillow which does not incumber the individual from movement.

A still further object of the present invention is to provide for a novel therapeutic between-the-legs pillow which is formed with a bias.

A still further object of the present invention is to provide for a novel therapeutic between-the-legs support pillow which is of one piece construction and substantially planar when not in use so as to provide for ease of storage on the bed with the look of a regular pillow.

SUMMARY OF THE INVENTION

A therapeutic between-the-legs support pillow having a generally rectangular foot print when not in use, having a first surface and a second channeled surface opposite the first surface, the second channeled surface having a first transverse channel proximate one longitudinal edge and second transverse channels proximate the lateral edge, the second channeled surface having a lateral bifurcation slot formed therein permitting the first planar surface to be folded upon itself at its lateral midpoint, the therapeutic pillow so folded being positioned between the individual's legs such that opposing portions of the first transverse longitudinal channel engages the opposing thighs and knees of the individual and the transverse lateral channels engage the opposing calves of the individual, the therapeutic between-the-legs support pillow being formed of one piece construction of a suitable polymer, foam or the like, which when folded upon itself as herein described performs as a biasing means between the legs of the individual, yet returns to its generally planar form for storage. The novel therapeutic between-the-legs support pillow as described herein will maintain its position between the legs of the individual, yet may incorporate a further fastening means depending upon the particular individual and intended use. The biasing means may be inherent in the material used in construction of the pillow or may be an active biasing means incorporated in the construction.

BRIEF DESCRIPTION OF THE DRAWINGS

These and other objects of the present invention will become evident particularly when taken in light of the following illustrations wherein.

DETAILED DESCRIPTION OF THE DRAWINGS

Figure 1:
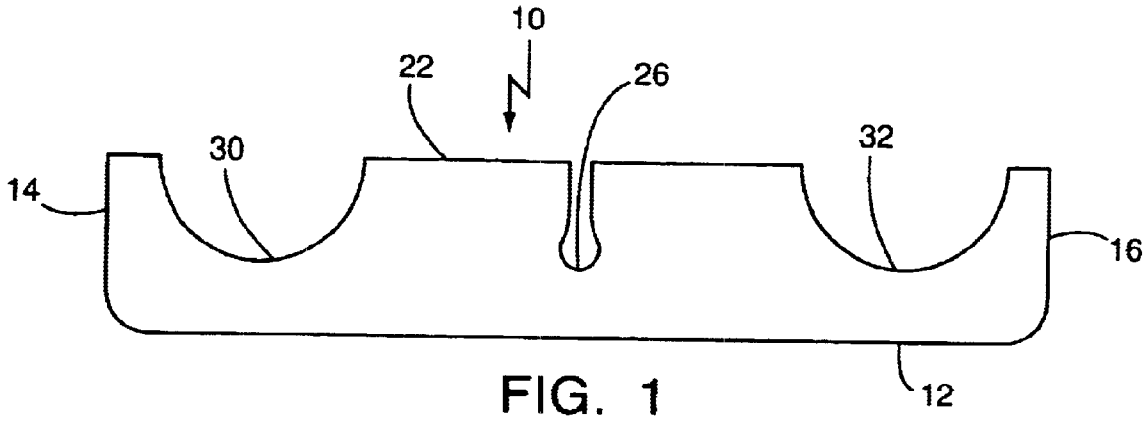
FIG. 1 is a side elevational view of the therapeutic pillow of the present invention.
Figure 2:
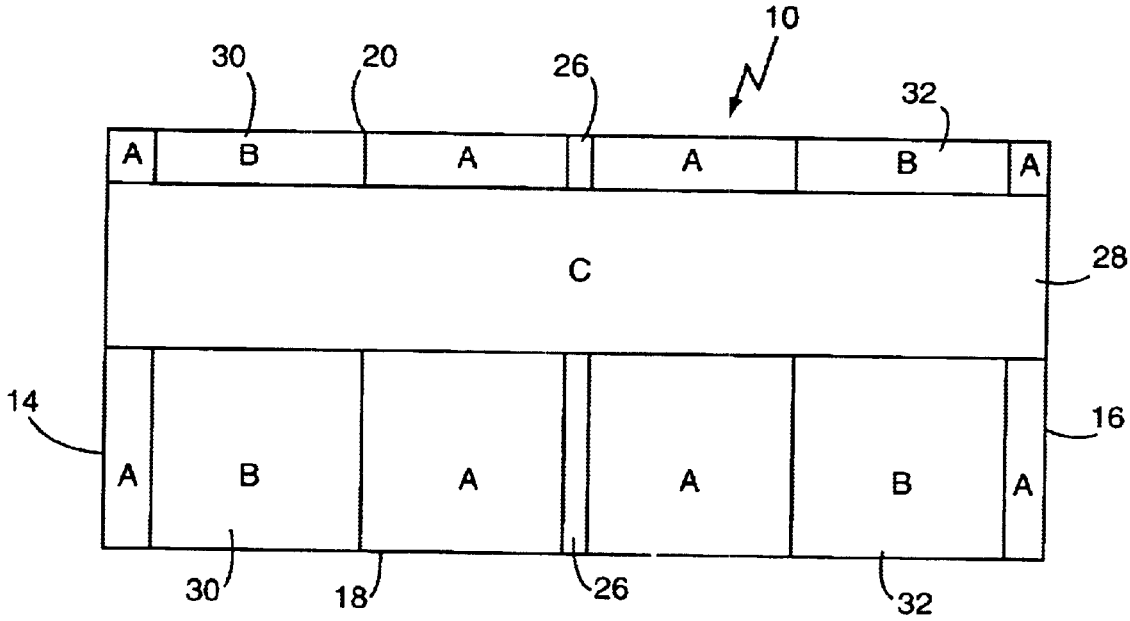
FIG. 2 is a top planar view of the therapeutic pillow of the present invention.
Figure 3:
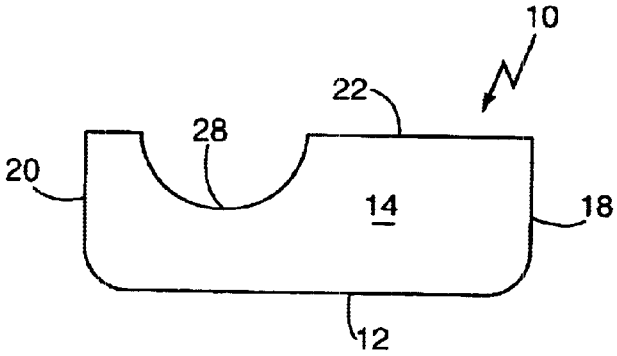
FIG. 3 is an end view of the therapeutic pillow of the present invention.

Referring to FIGS. 1, 2 and 3, there is illustrated a side elevational view and a top planar view and end view of the therapeutic between-the-legs pillow 10 of the present invention. Therapeutic between-the-legs pillow 10 has a generally rectangular foot print having a lower generally planar surface 12, which curves upwardly along its longitudinal and lateral edges to form end walls 14 and 16, and side walls 18 and 20.

Upper surface 22 has a plurality of different planar levels which are formed by the intersection of a plurality of channels formed in upper surface 22. Upper surface 22 is bifurcated by slot 26 which extends between side walls 18 and 20. There is then formed a longitudinal channel 28, which extends between end wall 14 and end wall 16. Channel 28 is offset from center and is proximate to side wall 20 and has an arcuate surface in cross section.

Channel 28 is intersected by lateral channels 30 and 32 which extend from side walls 18 to side wall 20 and our positioned on upper surface 22 proximate to end walls 14 and 16 respectively. Channels 30 and 32 are similarly arcuate in cross section. There are three levels of upper surface 22. The highest level areas are designated A. The intermediate levels are designated B. The lowest levels are designated C.

Figure 4:
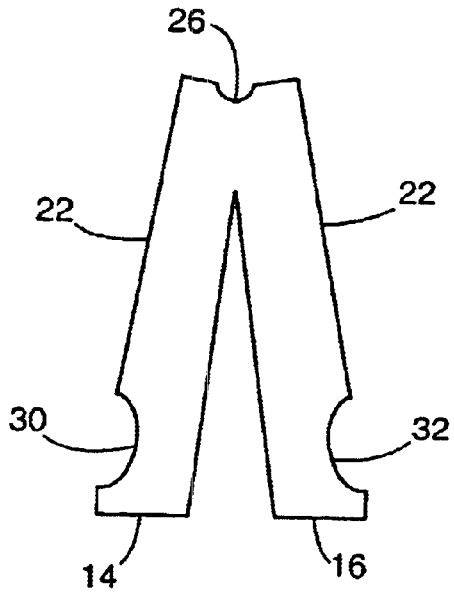
FIG. 4 is a side elevational view of the therapeutic pillow of the present invention when folded for insertion between the individual's legs.

The purpose of lateral slot 32 is to permit the therapeutic pillow 10 to be folded in half, thus bringing the two halves of lower surface 12 in proximation with each other as illustrated in FIG. 4. Depending upon the thickness of the therapeutic pillow, a second lateral slot 40 may be formed in lower surface 12, identical to lateral slot 32 to facilitate the folding. See FIG. 6.

Figure 5:
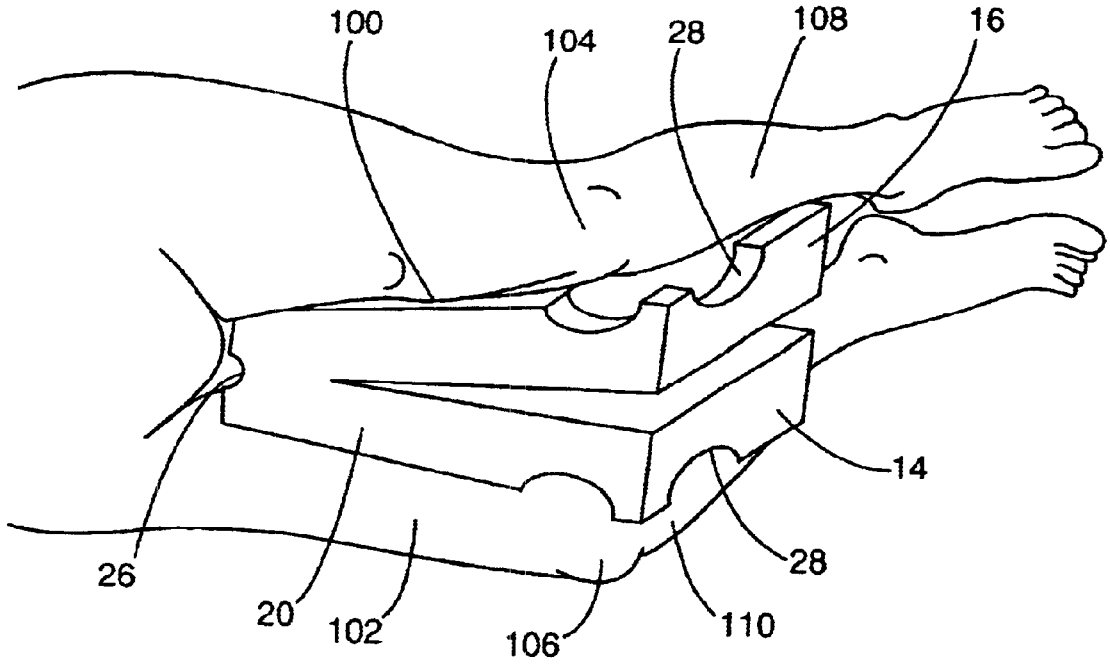
FIG. 5 is a perspective view of the therapeutic pillow of the present invention being positioned between the legs of an individual who is reclined on his or her side.

In the preferable embodiment thereof, therapeutic pillow 10 would be made of a foam or polymer substance such that when folded as illustrated in FIG. 4, it would resist maintaining that position and its inherent bias tendency would seek to return it to the position as illustrated in FIG. 1. This bias tendency is offset by the weight of the legs of the individual utilizing the therapeutic pillow as illustrated in FIG. 5. The biasing means is partially overcome by the weight of the individual, yet the biasing means does still exert some force and it is this exertion that maintains the legs of the individual in the proper position which also obviates the lower back pain and the myriad of maladies previously mentioned.

FIG. 5 is a perspective view of a lower portion of an individual's lower torso and legs engaging the therapeutic between-the-legs pillow 10. The inside thigh 100 and 102, the knees 104 and 106, and upper calves 108 and 110 would engage the respective channels 28, 30 and 32 on therapeutic pillow 10 with the legs moving towards each other as indicated, the therapeutic pillow 10 is engaged between the legs of the individual and folded upon itself wherein in this embodiment in which the therapeutic pillow 10 is formed of foam material, it has an inherent biasing means which maintains the legs in the correct spaced apart relationship.

Figure 6:
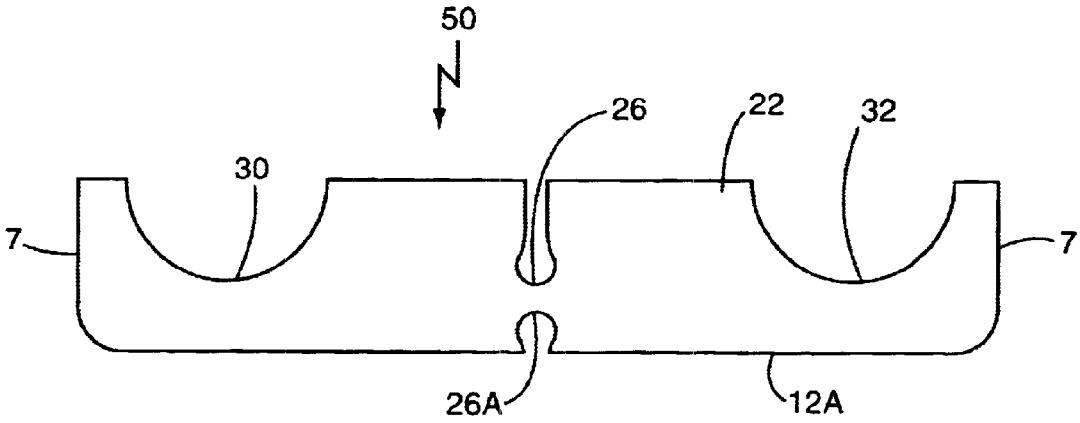
FIG. 6 is a side view of a second embodiment of the therapeutic pillow of the present invention.
Figure 7:
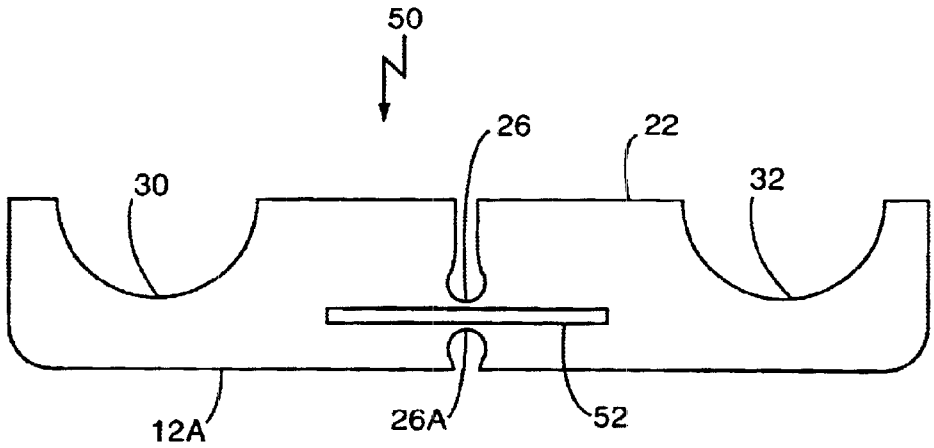
FIG. 7 is a cross sectional view along plane 7—7 of FIG. 5.

FIGS. 6 and 7 illustrate a second embodiment of the present invention. FIG. 6 is a side view of a therapeutic pillow 50 for use between the legs of an individual when in a reclined position on one side. This therapeutic pillow 50 is identical to that illustrated in FIG. 1 with respect to the channels formed on the upper surface. The difference between this particular therapeutic pillow and that illustrated in FIG. 1 is that this therapeutic pillow 50 would be constructed of a denser material as opposed to the foam material utilized in the embodiment illustrated in FIG. 1, and have a similar transverse slot 26A formed in lower surface 12A in alignment with slot 26 in upper surface 22. In the embodiment illustrated in FIG. 7 which is a cross sectional view along plane 7—7 of FIG. 6, the therapeutic pillow 50 would have incorporated therein an active biasing means 52 which biasing means would assist the return the therapeutic pillow to its substantial flat shape when not in use and provide the necessary biasing resistant when placed between the legs of the user. Since the material utilized to construct the therapeutic pillow 50 as illustrated in FIG. 6 and FIG. 7 is denser than that utilized for the embodiment illustrated in FIG. 1 and FIG. 2, the necessity of a second transverse slot 26A on the undersurface of therapeutic pillow 50 may be necessary to aid in the folding process.

The embodiments of the therapeutic pillow contained herein have been illustrated with the channeling means formed on the upper surface to contour and conform to the inner thighs, knees and inner calves of an individual user; hence the different levels since the thighs are normally more muscular than the calves. Therapeutic pillows disclosed herein could be sized accordingly in order that they could be used with individuals of various ages (children, teens, adults). Still further, while the channels provide for a specific interaction with the legs of an individual, it is possible that such a therapeutic pillow as disclosed herein could be formed without these channels formed therein using a material which had an inherent biasing means or incorporated an active biasing means. The flat surfaces would not be as effective in engaging the inner thigh, knee and inner calves of the individual and maintaining such a device in position, but the biasing means, whether inherent or active, would serve to provide for correct alignment of the spine.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A therapeutic leg support pillow for positioning between the legs of an individual in a reclining position to maintain and correct spinal alignment, the therapeutic leg support pillow comprising:

a resilient, biased pillow member having a rectangular footprint having a generally planar base surface, opposing side walls, opposing end walls and an upper surface, said upper surface having a plurality of intersecting channels defining a plurality of levels on said upper surface, said plurality of levels cooperative with inner thighs, knees and calves of an individual when said biased pillow member is folded in half upon said base surface and positioned between said inner thighs, knees and calves of said user, wherein one of said plurality of intersecting channels includes a longitudinal transverse channel extending from end wall to end wall and defining a lowest level of said plurality of levels of said upper surface, said longitudinal transverse channel being arcuate in cross section, and wherein said plurality of intersecting channels further includes two lateral transverse channels positioned proximate said end walls and traversing between said side walls, said two lateral transverse channels defining an intermediate level of said plurality of levels of said upper surface, said two lateral transverse channels being arcuate in cross section.

2. The therapeutic leg support pillow in accordance with claim 1 wherein one of said plurality of intersecting channels includes a transverse groove between said side walls, perpendicular to said side walls and bifurcating said upper surface of said therapeutic pillow, said transverse groove defining a fold demarcation for said therapeutic leg support pillow.

3. The therapeutic leg support pillow in accordance with claim 1 wherein said pillow is formed of a material having natural bias from said folded to said open position.

4. The therapeutic leg support pillow in accordance with claim 1 wherein said therapeutic leg support pillow is formed with a biasing member formed therein.

* * * * *